US005874397A

United States Patent [19]

Schimmel et al.

[11] Patent Number: 5,874,397

[45] **Date of Patent: *Feb. 23, 1999**

[54] GRANULAR DETERGENT BUILDER

[75] Inventors: Günther Schimmel, Erftstadt-Gymnich; Alexander Tapper, Mönchengladbach; Volker Thewes, Monheim, all of Germany

[73] Assignee: Hoechst Aktiengesellschaft, Frankfurt, Germany

[21] Appl. No.: 675,991

[22] Filed: Jul. 9, 1996

[ * ] Notice: This patent issued on a continued prosecution application filed under 37 CFR 1.53(d), and is subject to the twenty year patent term provisions of 35 U.S.C. 154(a)(2).

[30] Foreign Application Priority Data

Jul. 11, 1995 [DE] Germany ..... 195 25 197.0

[51] Int. Cl.[6] ..... C11D 3/10

[52] U.S. Cl. ..... 510/531; 510/108

[58] Field of Search ..... 510/108, 531

[56] References Cited

U.S. PATENT DOCUMENTS

| | | | |
|---|---|---|---|
| 4,664,839 | 5/1987 | Rieck | 252/175 |
| 4,820,439 | 4/1989 | Rieck | 252/135 |
| 4,820,441 | 4/1989 | Evans et al. | 252/174.18 |
| 4,891,148 | 1/1990 | Ouhadi et al. | 252/99 |
| 4,996,001 | 2/1991 | Ertle et al. | 252/99 |
| 5,066,415 | 11/1991 | Dany | 252/135 |
| 5,229,095 | 7/1993 | Schimmel et al. | 423/334 |
| 5,236,682 | 8/1993 | Schimmel et al. | 423/337 |
| 5,300,250 | 4/1994 | Morgan et al. | 252/135 |
| 5,480,578 | 1/1996 | Hirsch et al. | 252/174.25 |
| 5,540,855 | 7/1996 | Bailley et al. | 510/276 |
| 5,658,867 | 8/1997 | Pancheri et al. | 510/108 |

FOREIGN PATENT DOCUMENTS

| | | |
|---|---|---|
| 2108909 | 10/1992 | Canada . |
| 2130613 | 3/1995 | Canada . |
| 0164514 | 12/1985 | European Pat. Off. . |
| 0 416 366 A2 | 3/1991 | European Pat. Off. . |
| 0563631 | 10/1993 | European Pat. Off. . |
| 0425428 | 12/1993 | European Pat. Off. . |
| 0 578 986 A1 | 1/1994 | European Pat. Off. . |
| 0 614 965 A2 | 9/1994 | European Pat. Off. . |
| 4329392A1 | 3/1995 | Germany . |
| 4329394A1 | 3/1995 | Germany . |
| 4330868 | 3/1995 | Germany . |
| WO 9/18594 | 10/1992 | WIPO . |
| WO 92/18594 | 10/1992 | WIPO . |

*Primary Examiner*—Matthew V. Grumbling
*Attorney, Agent, or Firm*—Miles B. Dearth

[57] ABSTRACT

The invention relates to a granular detergent builder in the form of cogranules of a mixture of sodium bicarbonate and crystalline sheet silicates of the formula $NaMSi_xO_{2x+1}*yH_2O$, where M is sodium or hydrogen, x is a number from 1.9 to 4, and y is a number from 0 to 20, wherein a) the granular detergent builder contains 5 to 50% by weight of crystalline sheet silicate and 50 to 95% by weight of sodium bicarbonate;

b) has a pH of ≦10 in 1% strength solution in distilled water;

c) has a calcium-binding capacity of ≧150 mg Ca/g (30° German hardness) and a magnesium-binding capacity of ≧4 mg Mg/g (3° German hardness), and d) has an apparent density of ≧850 g/l.

The invention likewise relates to a process for the production of such a granular detergent builder, and to its use in detergents and cleaners.

11 Claims, 2 Drawing Sheets

Fig. 1: Calcium-binding capacity
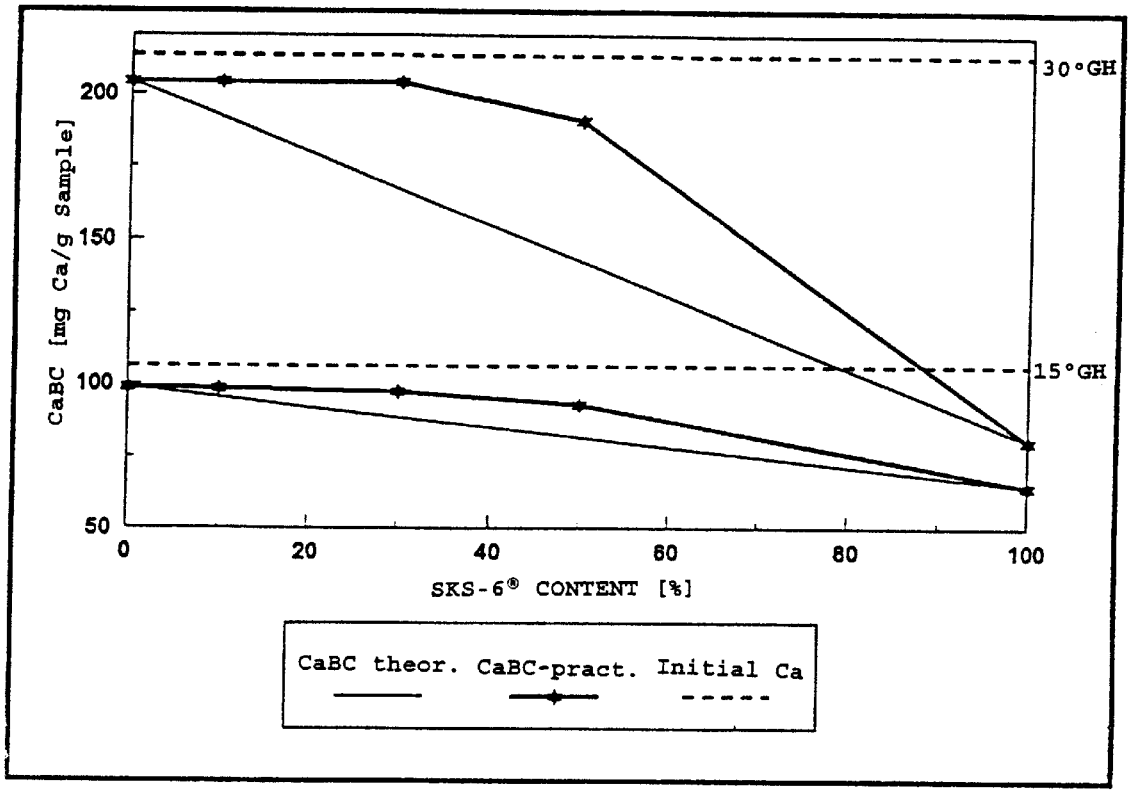

Fig. 2: Magnesium-binding capacity
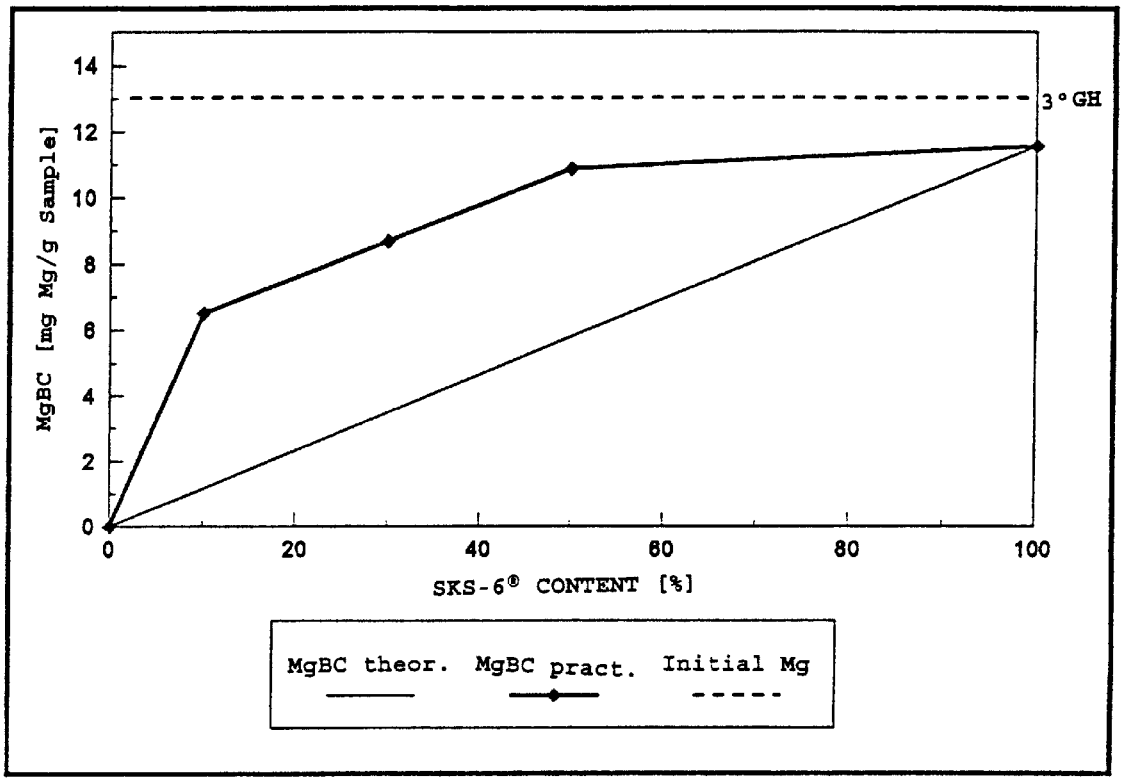

GRANULAR DETERGENT BUILDER

The present invention relates to a granular detergent builder in the form of cogranules of a mixture of sodium bicarbonate and crystalline sheet silicates of the formula $NaMSi_xO_{2x+1}*yH_2O$, where M is sodium or hydrogen, x is a number from 1.9 to 4, and y is a number from 0 to 20, to a process for its production and to its use.

For ecological reasons, phosphate-based builders, especially alkali metal tripolyphosphates such as, for example, sodium tripolyphosphate, are being displaced in detergents and cleaners by novel builder systems which, as a rule, consist of a synthetic, crystalline alumosilicate (for example zeolite A), a source of alkali (for example sodium carbonate), and at least one cobuilder. The cobuilders used are, singly or in combination with one another, or else in combination with other substances, normally nitrilotriacetic acid or its salts, phosphonates and also polycarboxylates, especially those based on acrylic and/or maleic acid.

The disadvantage of said cobuilders is their adverse ecological assessment. Thus, the polycarboxylates which are frequently used nowadays are non-biodegradable.

For this reason, many attempts have been made in the prior art to obtain a predominantly inorganic builder system.

EP-0 425 428 B1 discloses a process for the production of crystalline sodium silicates with a sheet structure, in which amorphous sodium silicate with a water content of 15 to 23% by weight is calcined in a rotary tube furnace at temperatures from 500° to 850° C., the calcined material is crushed and ground and then fed to a roller compactor, and then the resulting scales are precomminuted and screened and subsequently processed to granules with an apparent density of 700 to 1000 g/l.

DE-A 43 30 868 describes a process for the production of compacted, granular sodium silicates in which the sodium silicate with an average particle diameter of <500 $\mu$m is initially mixed with a material which increases its hardness before it is converted, by compacting, comminuting and screening, into compressed granules with particle sizes of from 0.1 to 5 mm.

EP-A 0 164 514 describes the use of crystalline sodium silicates for softening water which contains calcium and/or magnesium ions.

EP-A 0 563 631 discloses cogranules which readily disintegrate in water and have high apparent densities and are composed of aluminosilicates and crystalline sodium silicates with a sheet structure, a process for their production and their use.

The disadvantage of all alumosilicate-containing detergent formulations is the insolubility of the alumosilicates in water, which causes, inter alia, an increased sewage sludge loading. It is furthermore disadvantageous that relatively large agglomerates may form during the processing of alumosilicates or during their use, so that the use of cobuilders is necessary in order to disperse the alumosilicates into a suspension of fine primary particles, because agglomerates of alumosilicates, specifically of zeolite A, display no intrinsic tendency to disintegrate into primary particles.

The granules described in the abovementioned prior art display a softening of water which is in principle satisfactory, although it would be advantageous to be able to achieve a greater water-softening action so that anionic surfactants are able to display their activity to a greater extent.

Detergent formulations as described, for example, in PCT/WO 92/18594 have a pH of from 10 to 11 in 1% strength solution in distilled water at 20° C. Detergent builder formulations which contain, inter alia, sodium carbonate as source of alkali have an intrinsic pH of >10. Alkali-reduced detergents, by contrast, require other builders or builder combinations in which it would be desirable for the builder formulations to have an intrinsic pH in the range ≦10. A low pH makes a considerable contribution to preventing harm to delicate fabrics during the washing process.

It is therefore an object of the present invention to indicate inorganic-based substances which, having a high apparent density, readily disintegrate in water into the primary particles, whose intrinsic pH is in the range ≦b 10,which display an increased water-softening effect, and which reduce the sewage sludge loading owing to their solubility in water.

The invention therefore relates to a granular detergent builder in the form of cogranules of a mixture of sodium bicarbonate and crystalline sheet silicates of the formula $NaMSi_xO_{2x+1}*yH_2O$, where M is sodium or hydrogen, x is a number from 1.9 to 4, and y is a number from 0 to 20, wherein a) the granular detergent builder contains 5 to 50% by weight of crystalline sheet silicate and 50 to 95% by weight of sodium bicarbonate;

b) has a pH of ≦10 in 1% strength solution in distilled water;

c) has a calcium-binding capacity of ≧=150 mg Ca/g (30° German hardness) and a magnesium-binding capacity of ≧4 mg Mg/g (3° German hardness), and d) has an apparent density of ≧850 g/l.

It has been found, surprisingly, that the cogranules according to the invention display a greatly increased calcium- and magnesium-binding capacity in the form of a synergism (FIGS. 1 and 2). The synergism is manifested by the difference between the values found for the calcium- and magnesium-binding capacity and the calculated values for calcium and magnesium binding on the mixture line. The theoretical expectation necessary was that the values for the calcium and magnesium binding of the cogranules will obey, in the most favorable case, the following calculation formula (calculation of the mixture line) (SKS-6 stands for sheet silicate):

$$xBV = xBV(SKS\text{-}6® \text{ granules } 100\%)*w(SKS\text{-}6®) + xBV(NaHCO_3 \text{ granules } 100\%)*w(NaHCO_3)$$

x=Ca or Mg w=content by weight in the cogranules

The granular detergent builder preferably has an apparent density ≧900 g/l.

The degree of reaction between crystalline sheet silicate and sodium bicarbonate is preferably between 5 and 60%.

The sodium silicates in the granular detergent builder according to the invention preferably have an $SiO_2/Na_2O$ ratio of 1.9 to 2.1:1.

The present object is likewise achieved by a process for the production of a granular detergent builder in the form of cogranules of a mixture of sodium bicarbonate and crystalline sheet silicates of the general formula $NaMSi_xO_{2x+1}*yH_2O$, where M is sodium or hydrogen, x is a number from 1.9 to 4, and y is a number from 0 to 20, which comprises mixing sodium bicarbonate and sodium silicate together in powder form; feeding the mixture into a zone in which it is compacted between two counter-rotating rollers under pressure to give a solid (scales); comminuting the solid; and finally separating the required particle sizes from the oversize and undersize particles.

The pressure of the rollers in the abovementioned process preferably corresponds to a linear compressive force >20 kN/cm with a roller diameter of 200 mm.

The scales preferably have a temperature of ≦70° C.

The crystalline sodium disilicates with a sheet structure which are contained in the cogranules according to the invention (δ sodium disilicate is commercially obtainable under the name SKS-6® as commercial product from Hoechst AG, Federal Republic of Germany) dissolve slowly in water, which achieves a reduction in the pollution of the sludge in sewage treatment plants.

Since the disintegrant effect of the crystalline sodium disilicates present in the cogranules according to the invention is considerable, even small amounts of SKS-6® in the cogranules suffice for easy disintegration of the cogranules in water into the primary particles and for suspension of agglomerates or compacted material.

Because of the solubility of the crystalline sodium silicates present in the cogranules according to the invention in water, the sodium carbonate component in the detergent or cleaner formulation can be entirely omitted where appropriate, because the crystalline sodium disillicates are a supplier of alkali.

It is observed during the compaction that there is a temperature difference of at least 25° C. between the temperature of the initial powder mixture and the scale temperature. This increase in temperature can be explained by heat being released due to partial reaction between the granule components. It can be concluded from the determination, described hereinafter, of the degree of retention that this degree of reaction on use of SKS-6 and sodium bicarbonate is between 5 and 60%.

The invention likewise relates to the use of the granular detergent builder according to the invention in detergents and cleaners.

The abovementioned detergents and cleaners preferably contain 3 to 60% by weight of the granular detergent builder.

The detergents and cleaners may also contain in addition other detergent builders and other detergent auxiliaries.

The other detergent builders preferably comprise sodium tripolyphosphate, zeolite A, zeolite P, amorphous silicates, waterglass and/or alkali metal carbonates.

The other detergent ingredients preferably comprise surfactants, bleaches, bleach activators, bleach stabilizers, enzymes, polycarboxylates and/or carboxyl-containing cobuilders.

The analytical data on the cogranules according to the invention were determined by the following test methods.

Average particle diameter ($d_{50}$)

The particle size distribution is determined on a 50 gram sample by screen analysis (apparatus used: RETSCH VIBRATONIC), and the average particle diameter is determined from this by graphical evaluation.

Kinetics of disintegration

The granules to be investigated are screened for sample preparations through a screen (710 μm). The kinetics of disintegration in water (18° German hardness) are determined on the undersize particles as a function of time us a MICROTRAC Series 9200 (Leeds & Northrup GmbH).

Apparent density

The apparatus used to determine the apparent density complies with the requirements of DIN 53466. The weight in grams which occupies a volume of one milliliter under fixed conditions is determined. The process can be applied to free-flowing powders, and to substances in granule form. The apparent density is calculated by the following formula:

$$\text{apparent density}=(m_p-m_0)/V$$

where the following abbreviations apply:

$m_0$=weight of the empty measurement beaker in grams $m_p$=weight of the measurement beaker filled with product in grams V=volume of the measurement beaker in milliliters pH The pH of a 1% strength solution in distilled water at 20° C. is measured using a digital pH-meter CH 840 from SCHOTT.

Degree of retention

During the compaction, a more or less pronounced chemical reaction between the granule components may occur. The degree of retention provides information on the percentage of the initial components present side by side in unreacted form. The increase in temperature reached, owing to the amount of heat released during neutralization and the corresponding heat of solution, when 25 grams of the cogranule sample to be measured are added to 100 grams of distilled water is determined. The degree of retention is set in relation to the increase in temperature of the zero value, which is reached when, in place of the cogranules, only a corresponding physical mixture of the initial components is used in the determination. The degree of retention is calculated as follows:

$$\text{Degree of retention [\%]} = \frac{\text{temperature difference of the cogranules} \cdot 100\%}{\text{temperature difference of the zero value}}$$

Calcium-binding capacity 15 grams or 30 grams of a calcium solution (131.17 g of $CaCl_2*2H_2O$ are dissolved and made up to 5000 ml in distilled water) are made up to 999 grams with distilled water. The resulting solution has 15° or 30° German hardness, respectively. The solution is kept at 20° C. in a waterbath thermostat (ERWEXA) with stirring, and 1 gram of the cogranule sample to be measured is added. An automatic titrator (SCHOTT) is used to keep the pH of the solution constant at 10 with vigorous stirring at 20° C. for 10 minutes. The sample is then filtered through a fluted filter (Ederol 12). If the sample to be investigated contains carbonate, the filtrate must, because of the possibility of subsequent precipitations, be made strongly acidic (pH<2.5) with HCl so that excess carbonate can be removed from the filtrate in the form of $CO_2$ by stirring. The calcium remaining in the filtrate is then determined by complexometry. The calcium-binding capacity, generally referred to as the CBC., is calculated by forming the difference from the original calcium content.

Magnesium-binding capacity 50 grams of a magnesium solution (10.88 g of $MgCl_2*6H_2O$ are dissolved and made up to 5000 ml in distilled water) are made up to 999 grams with distilled water. The resulting solution has 3° German hardness. The solution is kept at 20° C. in a waterbath thermostat (ERWEKA) with stirring, and 1 gram of the cogranule sample to be measured is added. An automatic titrator (SCHOTT) is used to keep the pH of the solution constant at 10 with vigorous stirring at 20° C. for 10 minutes. The sample is then filtered through a fluted filter (Ederol 12). If the sample to be investigated contains carbonate, the filtrate must, because of the possibility of subsequent precipitations, be made strongly acidic (pH<2.5) with HCl so that excess carbonate can be removed from the filtrate in the form of $CO_2$ by stirring. The magnesium remaining in the filtrate is then determined by complexometry. The magnesium-binding capacity is calculated by forming the difference from the original magnesium content.

EXAMPLE 1

(Comparative Example)

90 kg of sodium bicarbonate were compressed in a compactor (Bepex GmbH) with a roller diameter of 200 mm and a linear compressive force of 20 to 30 kN/cm, and then ground to granules with $d_{50}$=775 μm. The granules were investigated for the particle size distribution, the kinetics of disintegration, the apparent density, the pH and the calcium- and magnesium-binding capacity. The compaction data are shown in Table 1, and the results found in the investigations are shown in Table 2.

EXAMPLE 2

(Comparative Example)

90 kg of sodium disilicate consisting mainly of δ–$Na_2SiO_5$(=SKS-6®) were compressed in analogy to Example 1 and ground to granules with $d_{50}$=782 μm. The granules were investigated as indicated in Example 1. The compaction data are shown in Table 1, and the results found in the investigations are shown in Table 2.

EXAMPLE 3

(According to the Invention)

45 kg of sodium bicarbonate and 45 kg of SKS-6® were premixed in an EIRICH mixer. The premix was compressed in analogy to Example 1 and ground to granules with $d_{50}$=783 μm. The granules were investigated as indicated in Example 1. In addition, the degree of retention was also determined. The compaction data are shown in Table 1, and the results found in the investigations are shown in Table 2.

EXAMPLE 4

(According to the Invention)

63 kg of sodium bicarbonate and 27 kg of SKS-6® were premixed in an EIRICH mixer. The premix was compressed in analogy to Example 1 and ground to granules with $d_{50}$=703 μm. The granules were investigated as indicated in Example 3. The compaction data are shown in Table 1, and the results found in the investigations are shown in Table 2.

EXAMPLE 5

(According to the Invention)

81 kg of sodium bicarbonate and 9 kg of SKS-6® were premixed in an EIRICH mixer. The premix was compressed in analogy to Example 1 and ground to granules with $d_{50}$=739 μm. The granules were investigated as indicated in Example 3. The compaction data are shown in Table 1, and the results found in the investigations are shown in Table 2.

TABLE 1

Compaction data for SKS-6 ® /$NaHCO_3$ cogranules

| Example | Compactor pressure [kN/cm] | Speed of rotation of hammer mill [rpm] | Initial temperature [°C.] | Scale temperature [°C.] |
|---|---|---|---|---|
| 1 | 25 | 700 | 22 | 39 |
| 2 | 30 | 700 | 22 | 45 |
| 3 | 24 | 700 | 22 | 52 |

TABLE 1-continued

Compaction data for SKS-6 ® /$NaHCO_3$ cogranules

| Example | Compactor pressure [kN/cm] | Speed of rotation of hammer mill [rpm] | Initial temperature [°C.] | Scale temperature [°C.] |
|---|---|---|---|---|
| 4 | 24 | 700 | 22 | 50 |
| 4 | 24 | 700 | 22 | 49 |

TABLE 2

Analytical data on SKS-6 ®/$NaHCO_3$ cogranules

| Example | 1 | 2 | 3 | 4 | 5 |
|---|---|---|---|---|---|
| Degree of retention [%] | — | — | 90.4 | 69 | 50.6 |
| CaBC (1 g/l) 30° GH | 204.2 | 80.2 | 190.4 | 204 | 204.1 |
| CaBC (1 g/l) 15° GH | 98.7 | 64.6 | 92.9 | 97.4 | 98.4 |
| MgBC (1 g/l) 3° GH | 0 | 11.6 | 10.9 | 8.7 | 6.5 |
| pH | 8.2 | 12.5 | 9.9 | 9.5 | 8.6 |
| Particle size spectrum | | | | | |
| [%] > 1180 μm | 3.4 | 5.5 | 2.9 | 2.2 | 2.4 |
| [%] > 710 μm | 54.1 | 52.6 | 55.8 | 47 | 49.8 |
| [%] > 425 μm | 28.5 | 24.8 | 27.4 | 30.7 | 29.9 |
| [%] > 212 μm | 11.4 | 11.4 | 10.4 | 15 | 14.3 |
| [%] > 150 μm | 0.5 | 0.3 | 0.5 | 0.9 | 0.9 |
| [%] > 53 μm | 1.6 | 1.7 | 1.8 | 3.2 | 2.4 |
| [%] < 53 μm | 0.5 | 3.7 | 1.2 | 1 | 0.3 |
| Apparent density [g/l] | 1010 | 845 | 910 | 940 | 983 |
| Kinetics of disintegration | | | | | |
| $d_{50}$ [μm] after 1 min | 0 | 10.5 | 10.2 | 11.3 | 11 |
| $d_{50}$ [μm] after 2 min | 0 | 9.6 | 9.5 | 10.2 | 10 |
| $d_{50}$ [μm] after 4 min | 0 | 9.2 | 8.7 | 9.1 | 8.8 |
| $d_{50}$ [μm] after 6 min | 0 | 8.9 | 8.2 | 8.4 | 8.1 |
| $d_{50}$ [μm] after 8 min | 0 | 8.7 | 7.9 | 8 | 7.7 |
| $d_{50}$ [μm] after 10 min | 0 | 8.6 | 7.7 | 7.6 | 7.3 |

We claim:

1. A granular detergent builder in the form of cogranules of a mixture of sodium bicarbonate and crystalline sheet silicates of the formula $NaMSi_xO_{2x+1}*yH_2O$, where M is sodium or hydrogen, x is a number from 1.9 to 4, and y is a number from 0 to 20, wherein a) the granular detergent builder contains 5 to 50% by weight of crystalline sheet silicate and 50 to 95% by weight of sodium bicarbonate;

b) has a pH of ≦10 in 1% strength solution in distilled water;

c) has a calcium-binding capacity of ≧150 mg Ca/g (30° German hardness) and a magnesium-binding capacity of ≧4 mg Mg/g (3° German hardness), and d) has an apparent density of ≧850 g/l.

2. A granular detergent builder as claimed in claim 1, which has an apparent density ≧900 g/l.

3. A granular detergent builder as claimed in claim 1, wherein the reaction between crystalline sheet silicate and sodium bicarbonate is between 5 and 60%.

4. A granular detergent builder as claimed in claim 1, wherein the crystalline sodium silicate has an $SiO_2/Na_2O$ ratio of 1.9 to 2.1:1.

5. A process for the production of a granular detergent builder in the form of cogranules of a mixture of sodium bicarbonate and crystalline sheet silicates of the formula $NaMSi_xO_{2x+1}*yH_2O$, where M is sodium or hydrogen, x is a number from 1.9 to 4, and y is a number from 0 to 20, which comprises mixing sodium bicarbonate and sodium silicate together in powder form; feeding the mixture into a zone in which it is compacted between two counter-rotating rollers under pressure to give a solid (scales); comminuting the solid; and finally separating the required particle sizes from the oversize and undersize particles.

6. The process as claimed in claim 5, wherein the pressure of the rollers corresponds to a linear compressive force of >20 kN/cm with a roller diameter of 200 mm.

7. A process as claimed in claim 5, wherein the scales have a temperature ≦70° C.

8. A detergent or cleaner containing 3 to 60% by weight of the granular detergent builder of claim 1.

9. A detergent or cleaner as claimed in claim 8, which additionally contains other detergent builders and other detergent auxiliaries.

10. A detergent or cleaner as claimed in claim 9, wherein the other detergent builders are sodium tripolyphosphate, zeolite A, zeolite P, amorphous silicates, waterglass and/or alkali metal carbonates.

11. A detergent or cleaner as claimed in claim 9, wherein the other detergent ingredients are surfactants, bleaches, bleach activators, bleach stabilizers, enzymes, polycarboxylates and/or carboxyl-containing cobuilders.

* * * * *